US006149182A

United States Patent [19]

Wyssen

[11] Patent Number: 6,149,182

[45] Date of Patent: Nov. 21, 2000

[54] DEVICE FOR MODIFYING THE LATERAL BENDING OF A SKI BOOT

[75] Inventor: Jürg Wyssen, Reichenbach im Kandertal, Switzerland

[73] Assignee: Marker Deutschland GmbH, Germany

[21] Appl. No.: 09/297,247

[22] PCT Filed: Oct. 29, 1997

[86] PCT No.: PCT/EP97/05970

§ 371 Date: Apr. 27, 1999

§ 102(e) Date: Apr. 27, 1999

[87] PCT Pub. No.: WO98/18528

PCT Pub. Date: May 7, 1998

[30] Foreign Application Priority Data

Oct. 31, 1996 [CH] Switzerland ..... 2685/96
Aug. 29, 1997 [CH] Switzerland ..... 2029/97

[51] Int. Cl.[7] ..... A63C 9/08

[52] U.S. Cl. ..... 280/626; 280/611; 280/607; 280/617

[58] Field of Search ..... 280/611, 607, 280/601, 613, 617, 618, 626, 602, 634

[56] References Cited

U.S. PATENT DOCUMENTS 4,141,570 2/1979 Sudmeier ..... 280/607
4,896,895 1/1990 Bettosini ..... 280/607 X
5,026,087 6/1991 Wulf et al. ..... 280/613
5,412,883 5/1995 Wulf et al. ..... 280/613 X
5,671,939 9/1997 Pineau ..... 280/607 X
5,785,342 7/1998 Bronson ..... 280/607 X

FOREIGN PATENT DOCUMENTS 2673546 9/1992 France .
2 255 406 5/1974 Germany .
2603676 8/1977 Germany ..... A63C 9/00
WO 96/28225 9/1996 WIPO .

*Primary Examiner*—J. J. Swann
*Assistant Examiner*—F. Zeender
*Attorney, Agent, or Firm*—D. Peter Hochberg; William H. Holt; Michael J. Corrigan

[57] ABSTRACT

An adjusting device for adjusting the angle between a ski boot and a sliding surface of an associated ski. The adjusting device operates as a function of parameters correlated with turning of the associated ski by a skier causing parameter-dependent pivoting of the ski boot relative to the sliding surface of the ski. During a turn, the sliding surface of the ski is inclined to an angle greater than the boot giving the skier better ski edge penetration.

9 Claims, 10 Drawing Sheets

DEVICE FOR MODIFYING THE LATERAL BENDING OF A SKI BOOT

Figure 1:
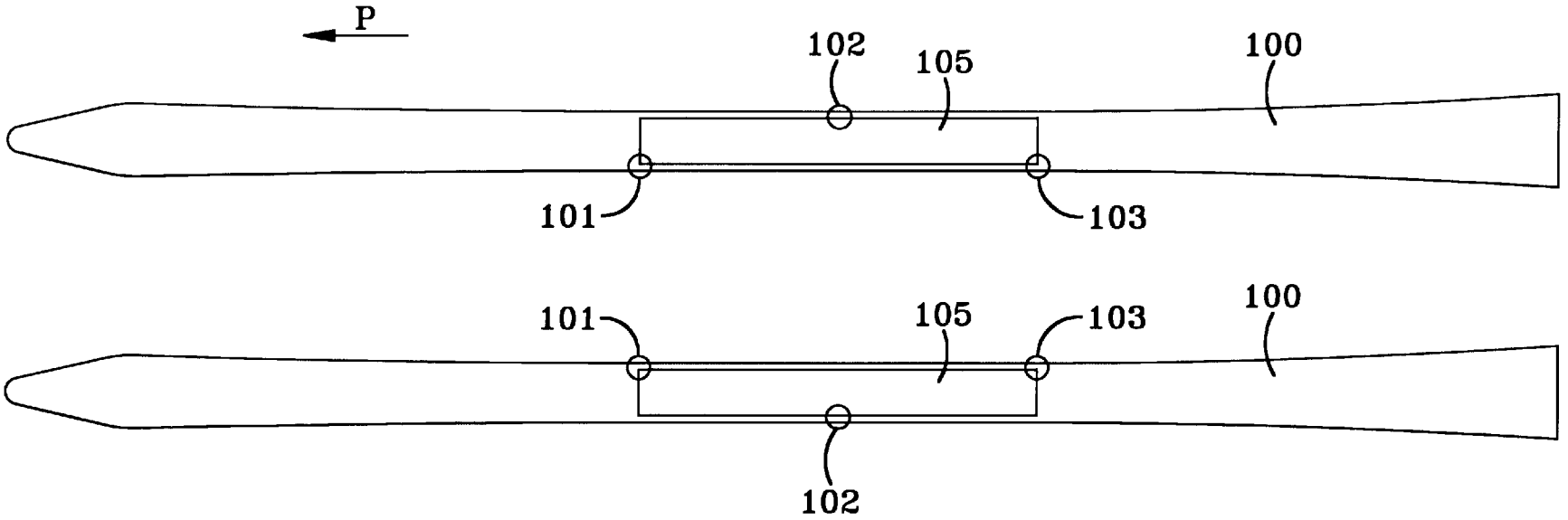

The invention relates to a device for adjusting an angle in the sideways direction between a ski boot or skier's leg and sliding surface of an associated ski.

In the case of modern ski boots, it is frequently possible to have a pivoting adjustment of the boot shaft relative to the boot sole about a longitudinal axis of the boot. An appropriate adjustment—also referred to as canting adjustment—can compensate for anatomical peculiarities of the skier, e.g. bow legs or knock knees, such that, when the legs are comfortably positioned, the sliding surfaces of the ski are located in a common plane or in mutually parallel planes. This makes it easier for the skier to avoid undesired canting of the ski.

In the case of a ski known from DE 26 03 676 A1, there is arranged between the ski boot and ski a standing plate, of which the boot-side, top side is arranged in a pivotably adjustable manner about a longitudinal axis of the ski relative to the ski-side, underside, it being the case that said pivoting adjustment takes place by a longitudinal adjustment of wedge elements between the top side and underside of the standing plate. A canting adjustment is also thereby possible.

Irrespective of the canting adjustment in each case, during turning the angle at which those edges of the ski which are on the inside of the turning curve dig into the underlying surface is determined by the angle at which the skier inclines his/her legs toward the inside of the turning curve in comparison with the situation where he/she is skiing normally straight ahead.

The object of the invention, then, is to present new ways of controlling the canting of the ski.

This object is achieved according to the invention in that an adjusting device, which operates as a function of parameters correlated with turning, causes parameter-dependent pivoting of the ski boot or of the boot shaft about a longitudinal axis of the ski relative to the sliding surface of the ski and/or a parameter-dependent adjusting force, which tries to pivot the boot or its shaft in sideways direction relative to the sliding surface of the ski such that, during turning, at least one predetermined ski is guided with edge pressure and/or canting which is increased in relation to the sideways inclination of the boot or leg.

In this context, it is provided, in particular, that, via the adjusting device, bending of the respective ski which occurs during turning—at least when the skier or his/her legs are inclined obliquely with respect to the inside of the turning curve—controls sideways tilting of the ski boot or of its shaft relative to the associated ski such that the vertical axis of the sliding surface of the predetermined ski, in particular of the ski on the outside of the turning curve, is inclined toward the inside of the turning curve to a more pronounced extent than the vertical axis of the associated ski boot or its shaft.

The invention is based on the general idea of using parameters which are characteristic of turning, to be precise in particular the bending of the ski which occurs during turning, the longitudinal ends of said ski bending upward, in the direction of the vertical axis of the ski, relative to the central region of the ski during turning, for the purpose of controlling sideways pivoting of the ski boot or its shaft or of controlling a corresponding adjusting force, in order to increase the edging or edge pressure at least of one ski during turning.

In the case of current skiing techniques, it is the ski on the outside of the turning curve in particular which is subjected to loading during turning, with the result that the edging of this ski during turning is of increased importance. Accordingly, it is expediently provided for the adjusting device to be designed such that it is the ski on the outside of the turning curve in each case which has the increased edging or edge pressure. However, it is also possible, in principle, to cause a pivoting adjustment or adjusting force for increased edging or edge pressure for the ski which is on the inside of the turning curve. The invention is thus also suitable, in principle, for new and/or future methods of skiing.

If the changes in angles between the sliding surface and boot shaft or the adjusting forces acting between the boot shaft and sliding surface are opposed to one another for the right and left ski, all that is required is for the right and left ski to be changed over if it is desired to have increased edging or edge pressure for the ski on the inside of the turning curve rather than the ski on the outside of the turning curve during turning.

The adjusting device may advantageously be arranged between the ski and the ski binding and assume, for example, the function of a spacer or base plate, on which the ski boot is supported with vertical spacing from the top side of the ski and, during skiing, secured by a ski binding which, for its part, may be fitted on the spacer or base plate.

However, it is also possible and advantageous for the adjusting device to be provided as part of the ski or combined with the boot. In the first case, it is possible, for example, for the top side of the ski, in a parameter-dependent manner, to be inclined about a longitudinal axis of the ski relative to the sliding surface of the ski in the region of the ski bindings or of the ski boot. In the other case, it is possible for the shaft of the ski boot, in a parameter-dependent manner, to be pivoted sideways relative to the boot sole.

Figure 2:
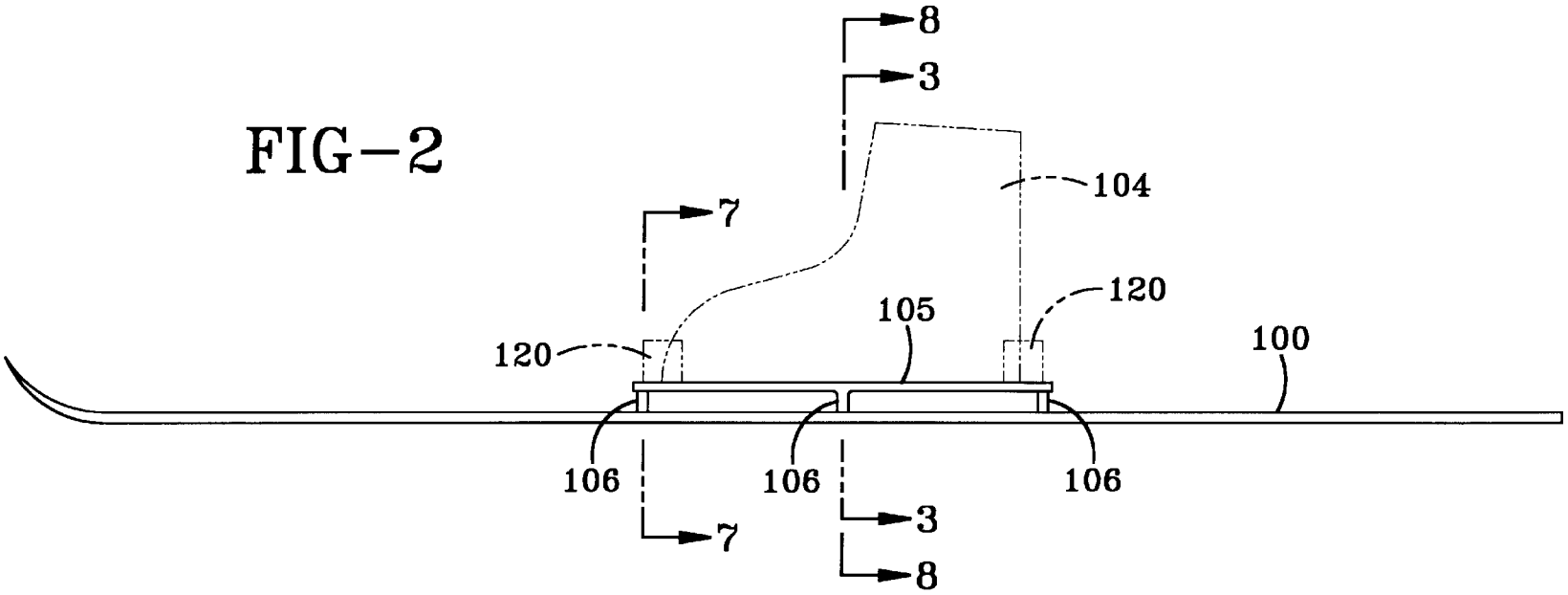
Figure 3:
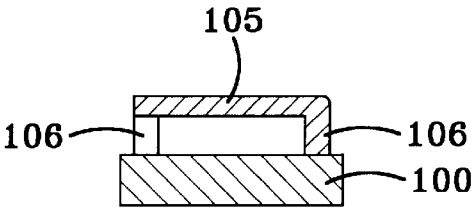
Figure 4:
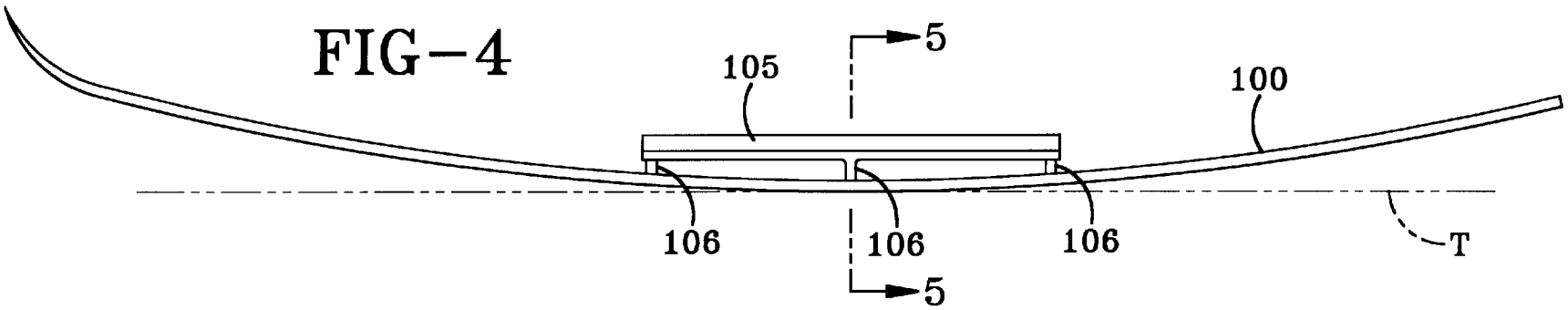
Figure 5:
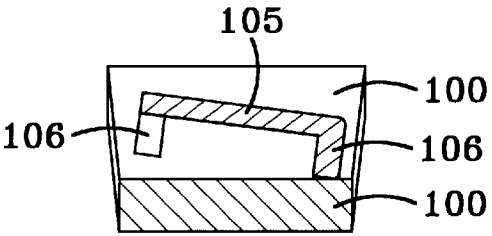
Figure 6:
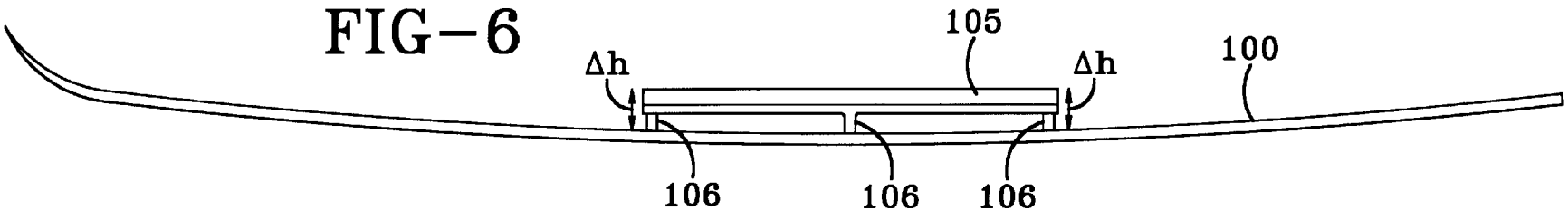
Figure 7:
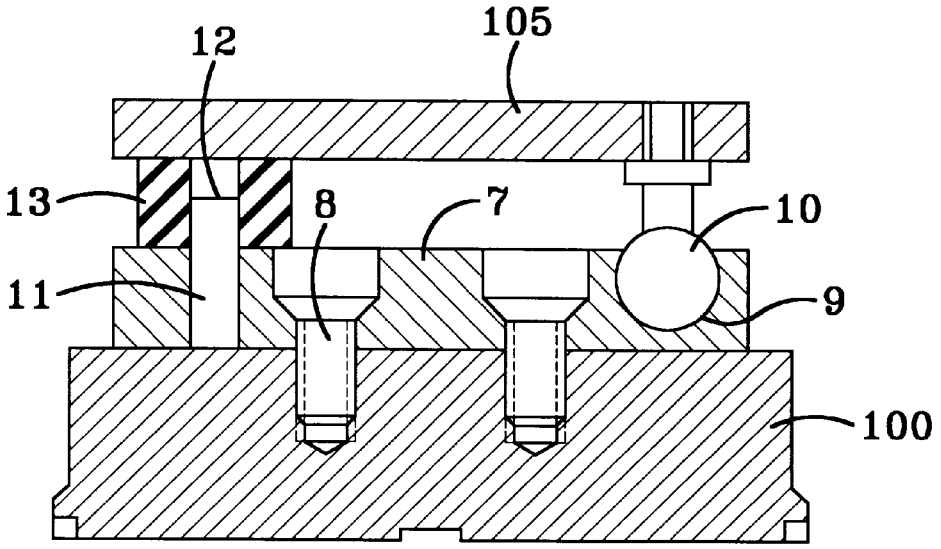
Figure 8:
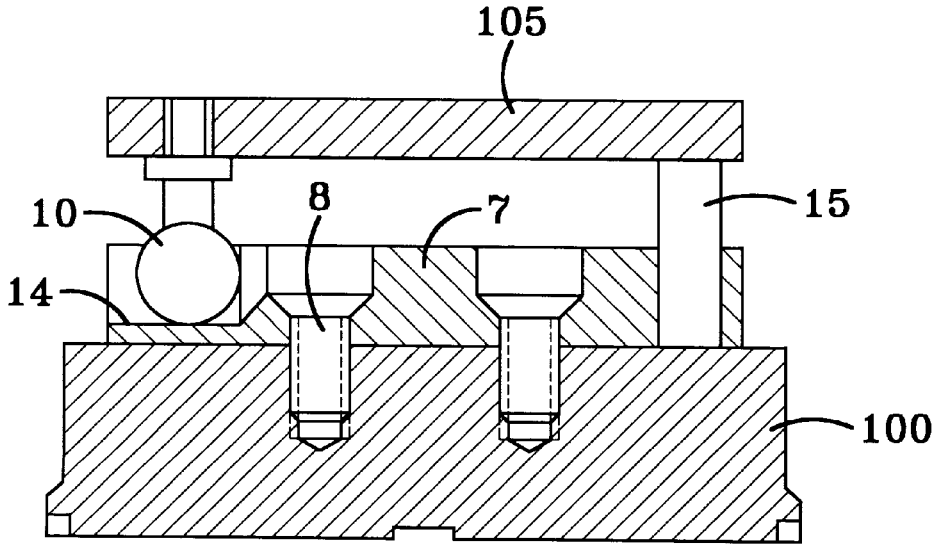
Figure 9:
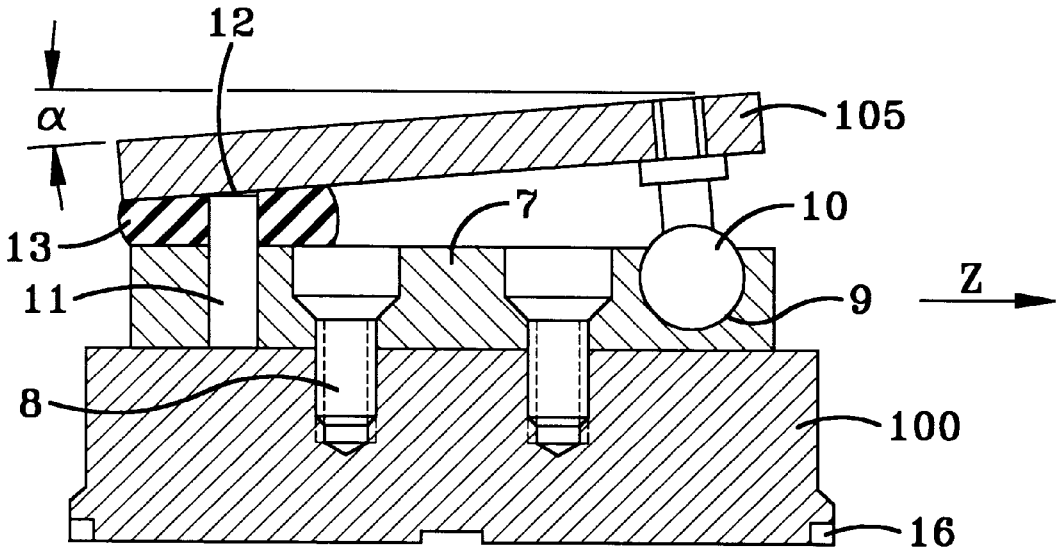
Figure 10:
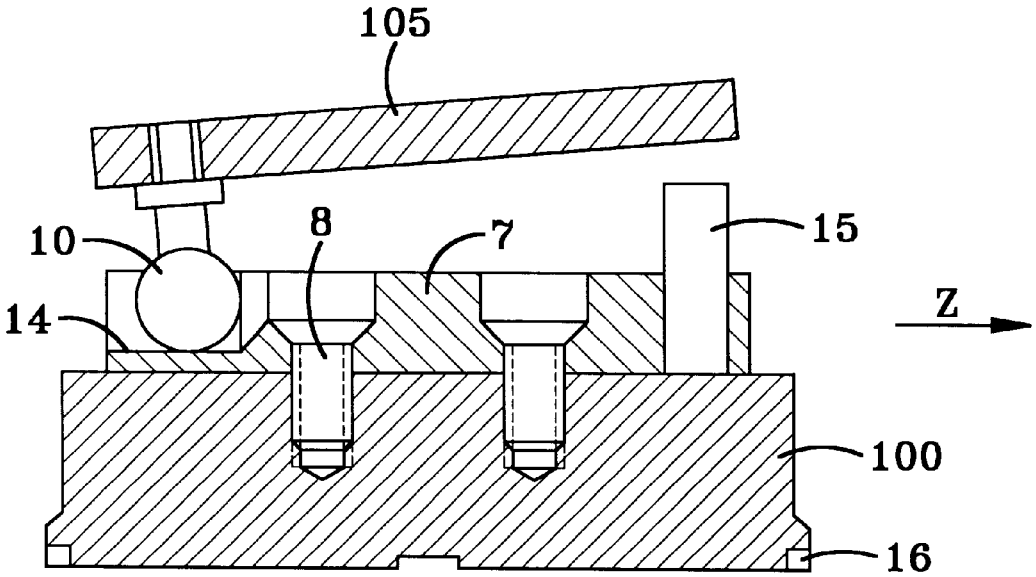
Figure 11:
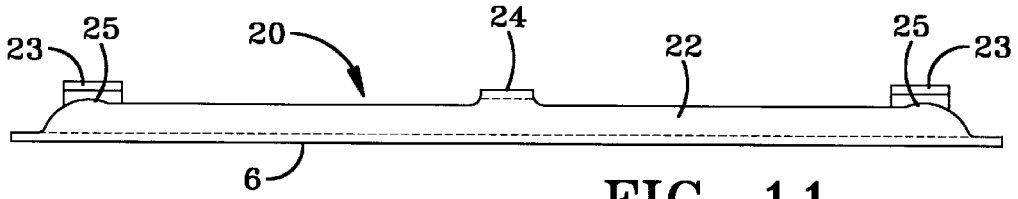
Figure 12:
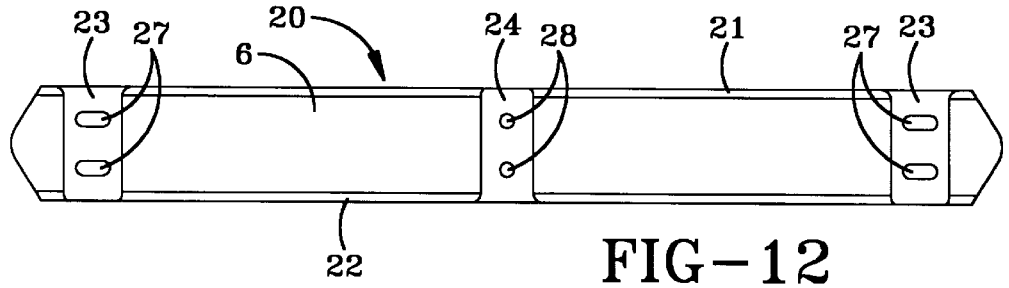
Figure 13:
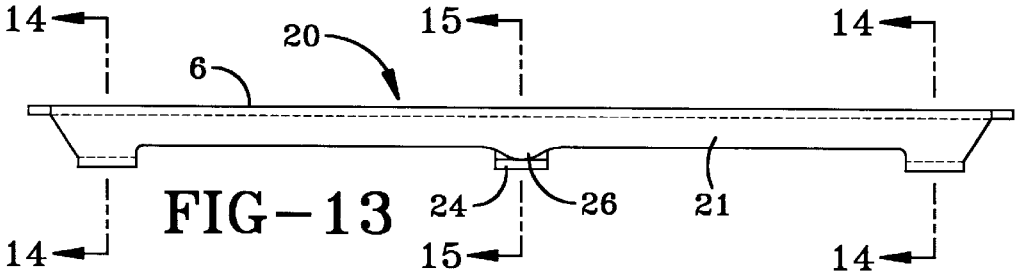
Figure 14:
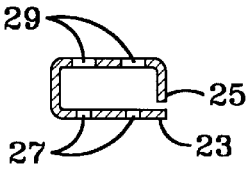
Figure 15:
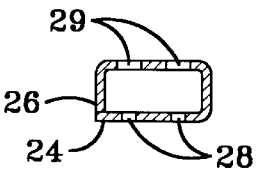
Figure 16:
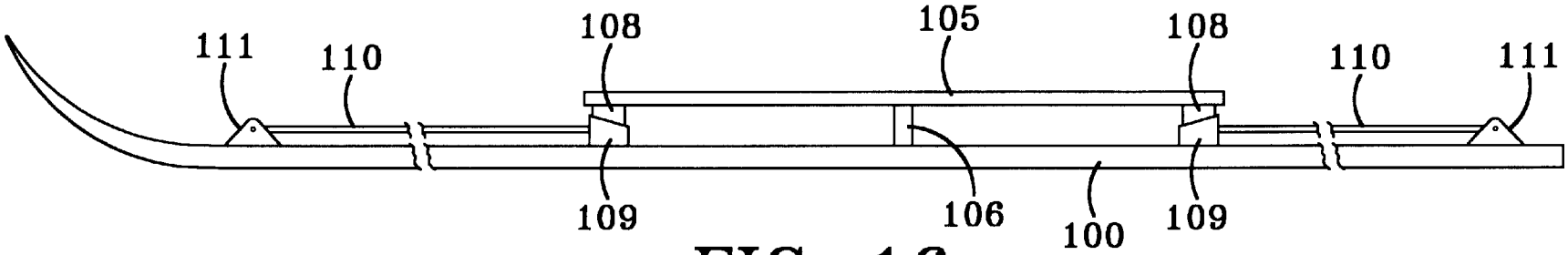
Figure 17:
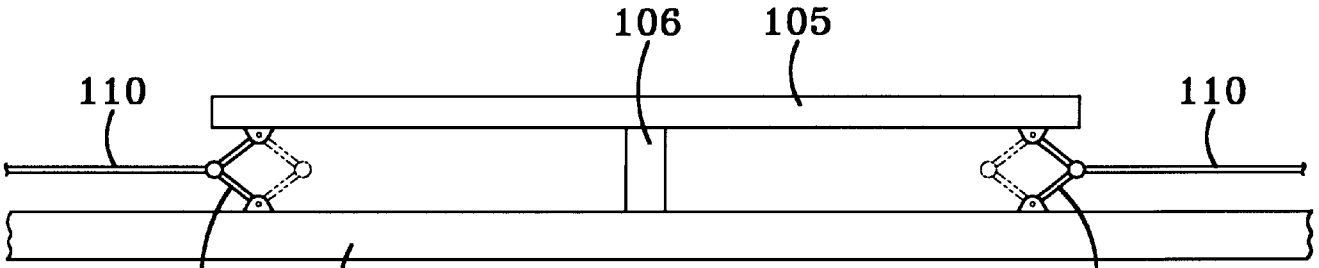
Figure 18:
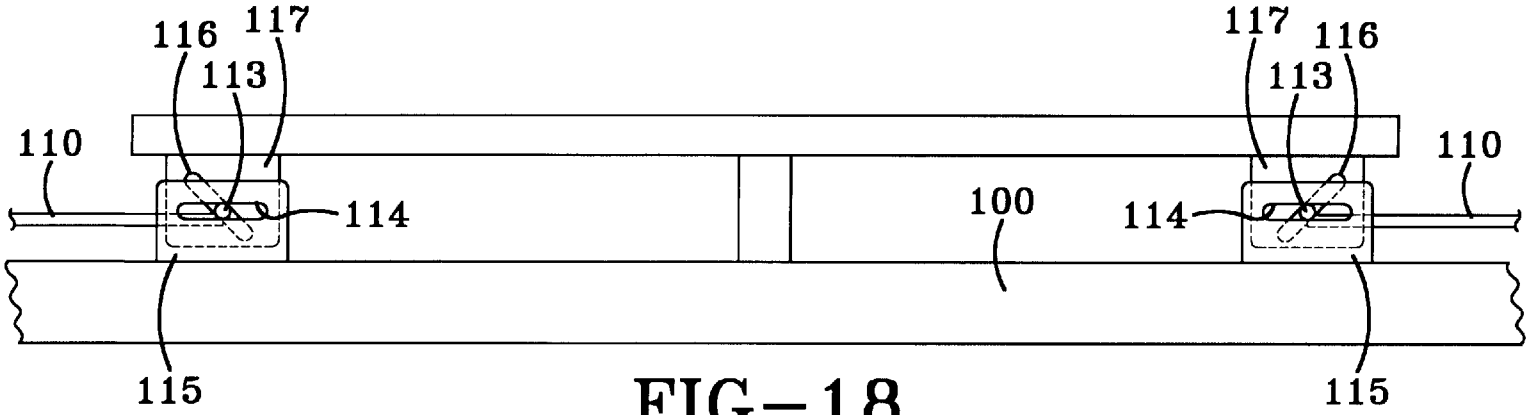
Figure 19:
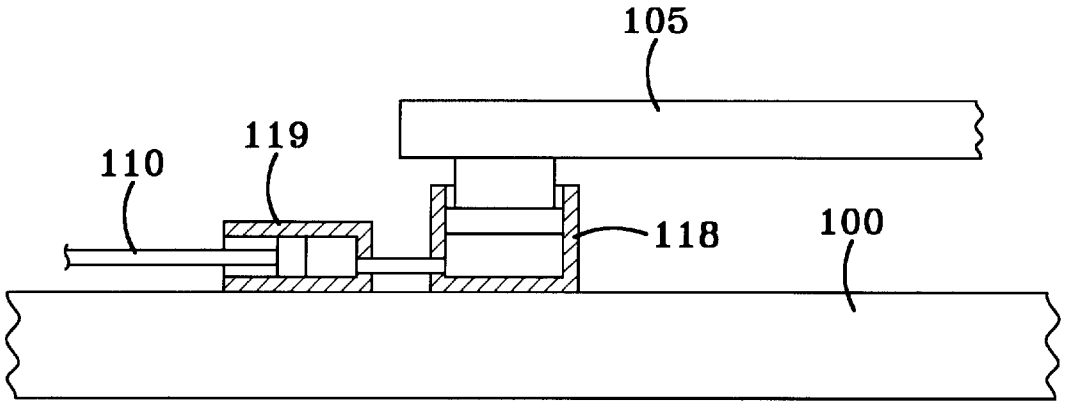
Figure 20:
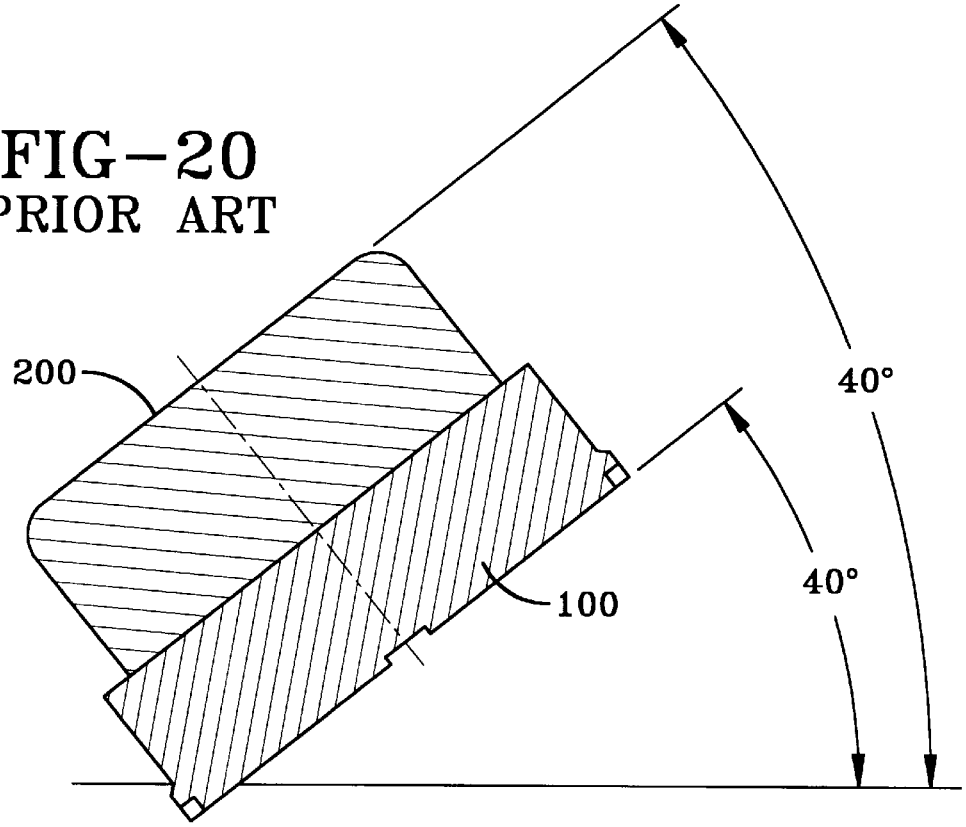
FIG-20 PRIOR ART
Figure 21:
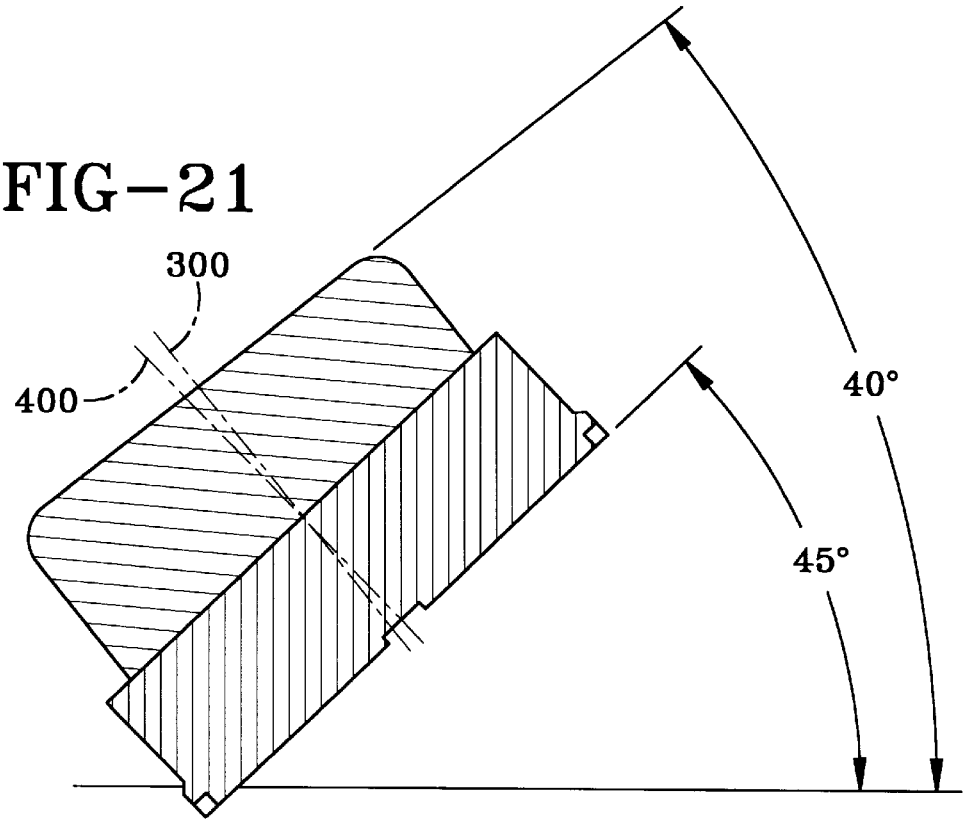
Figure 22:
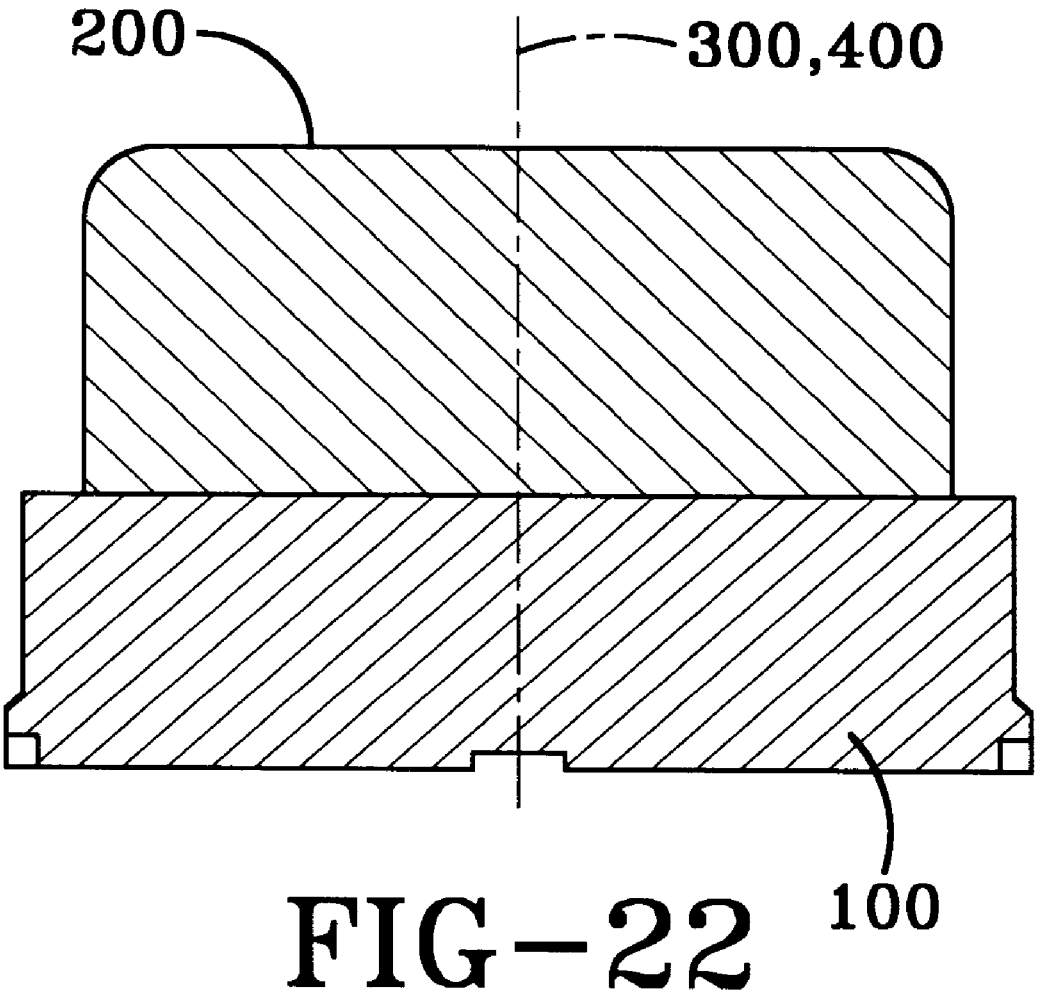

Otherwise, as far as preferred features of the invention are concerned, you are referred to the claims and to the following explanation of the drawing, with reference to which the functioning of the invention and particularly preferred embodiments are described more precisely. In the drawing:

FIG. 1 shows a plan view of a pair of skis,

FIG. 2 shows a ski in side view, the figure illustrating the state in which a skier is skiing normally straight ahead on a level piste, FIG. 3 shows a sectional illustration corresponding to the section line III—III in FIG. 2, FIG. 4 shows a side view of the ski in a bent state characteristic of turning, FIG. 5 shows a sectional illustration corresponding to section line V—V in FIG. 4, FIG. 6 shows a side view, corresponding to FIG. 4, of a ski during turning, said ski having a comparatively flexurally rigid central region, FIG. 7 shows a sectional illustration corresponding to section line VII—VII in FIG. 2 with design details, the figure illustrating the state in which the skier is skiing normally straight ahead, FIG. 8 shows a sectional illustration corresponding to section line VIII—VIII in FIG. 2 with design details, the figure illustrating, again, the state in which the skier is skiing normally straight ahead, FIG. 9 shows a sectional illustration, corresponding to FIG. 7, during turning, FIG. 10 shows a sectional illustration, corresponding to FIG. 8, during turning, FIG. 11 shows a side view of a further adjusting device, the top side of the adjusting device being located at the bottom in FIG. 11, FIG. 12 shows a view of the underside of the adjusting device, FIG. 13 shows a further side view of the adjusting device, this figure illustrating the side which is located opposite the view of FIG. 11 and the top side of the adjusting device being located at the top, FIG. 14 shows a sectional illustration of the abovementioned adjusting device corresponding to section lines XIV—XIV in FIG. 13, FIG. 15 shows a sectional illustration of the adjusting device corresponding to section line XV—XV in FIG. 13, FIG. 16 shows the side view of a ski with a further adjusting device illustrated schematically, FIG. 17 shows an illustration, corresponding to FIG. 16, of a further modified embodiment, FIG. 18 shows a further-modified embodiment, FIG. 19 shows a side view of a ski with hydraulically controlled adjusting device, FIG. 20 shows a schematic cross section of a conventional ski in canted position, FIG. 21 shows a corresponding cross section in the case of a ski which has been equipped according to the invention and, FIG. 22 shows a cross section of a ski which has been equipped according to the invention running normally straight ahead.

FIG. 1 illustrates a pair of skis 100 in plan view, the forward direction of travel being indicated by arrow P.

Three supporting zones 101, 102, and 103 are provided on each ski, it being the case that the supporting zones 101 and 103 are located on the inside of the respective ski and are spaced apart from one another in a longitudinal direction of the ski, while the supporting zone 102 is located on the outside of the ski in each case and is offset in the longitudinal direction of the ski with respect to the two supporting zones 101 and 103.

Let us then assume that there is arranged on each ski 100 a base plate 105 which is designed as a standing surface for a ski boot 104, indicated by dashed lines in FIG. 2 only, and which also forms the base for ski-binding units 120, which are indicated by dashed lines in FIG. 2 and secure the ski boot on the respective base plate 105 during skiing.

Each base plate 105, then, is secured on the associated ski 100, in the region of the supporting zones 101 to 103, by supporting elements 106 on the ski 100, with the result that the top side of the base plate 105 is spaced apart from the top side of the respective ski 100 to a more or less pronounced extent. The supporting elements 106 are arranged with a certain capacity for movement or flexibility relative to the base plate 105 and/or relative to the respective ski 100, such that relative movements between the base plate 105 and ski 100 are possible in the longitudinal direction of the ski in the region of the supporting zones 101 and 103 and in the transverse direction of the ski in the region of the supporting zone 102.

When the skier is skiing normally straight ahead on a level piste, each ski 100, according to FIG. 2, is in a planar or non-bent state, with the result that the base plate 105, according to FIGS. 1 and 3, assumes a position parallel to the plane of the underside or sliding surface of the ski 100 when the supporting elements 106, as illustrated, support the top side of the base plate 5 such that it is spaced apart from the underside of the ski by identical spacings in each case.

During turning, the skier will shift the center of gravity of his/her body toward the inside of the turning curve to a more or less pronounced extent, with the result that the skis 100 are canted to a more or less pronounced extent such that the vertical axes of the skis in each case are inclined toward the inside of the turning curve to a more or less pronounced extent. At the same time, the ski 100, according FIG. 4, will bend, i.e. the longitudinal ends of the ski 100 are bent up relative to the central region of the ski 100.

This is synonymous with the supporting zones 101 to 103, or those zones on the underside of the ski or sliding surface of the ski 100 which correspond to said supporting zones 101 to 103, being located on a plane which is curved in the longitudinal direction of the ski, i.e., in relation to a plane T which is in tangential contact with the underside or sliding surface of the ski 100 in the vicinity of the supporting zone 102, the supporting zone 102 is located at a lower level than the supporting zones 101 and 103.

This results in the base plate 105, corresponding to FIGS. 4 and 5, tilting in the sideways direction relative to the longitudinal axis of the ski.

Arranging the supporting zones 101 to 103 on a pair of skis according to FIG. 1 achieves the situation where the vertical axis of the ski on the outside of the turning curve is inclined toward the inside of the turning curve to a more pronounced extent than the vertical axis of the base plate 105, of which the inclination is predetermined by the sideways inclination of the skier's legs. As a result, that longitudinal edge of the ski on the outside of the turning curve which is on the inside of the turning curve digs in to a considerably enhanced extent in relation to the sideways inclination of the skier's leg in each case because the canting of said ski, directed toward the inside of the turning curve, can exceed to a considerable extent the degree of inclination of the skier's leg, directed toward the inside of the turning curve.

In the example of FIGS. 1 to 5, there will be a reduction in canting for the ski 100 on the inside of the turning curve in each case. However, this is of very minor importance since in the case of modern skiing techniques, during turning, the ski on the outside of the turning curve is subjected to loading to a considerably more pronounced extent that the ski on the inside of the turning curve and, accordingly, the turning depends decisively on the edging of the ski on the outside of the turning curve.

If, however, a new skiing technique which places the importance on the loading of the ski on the inside of the turning curve, and the canting of said ski, were to be created, then the skier, in FIG. 1, would just have to change over the right and left ski 100 in order to bring about increased edging of the ski on the inside of the turning curve.

The invention is not restricted to skis 100 with a central region which can bend. Should a ski 100, according to FIG. 6, have a central region which, to the greatest possible extent, is stiff, the ski merely having flexible ends, it is possible to provide supporting elements 106 with a controllable height and to control, for example, the height of the supporting elements in the region of the supporting zones 101 and 103, or the height of the supporting element 106 in the region of the supporting zone 102, as a function of the bending displacement of the front and/or rear end of the ski. The example in FIG. 6 indicates the capacity for controlling the height of the supporting elements 106 in the region of the supporting zones 101 and 103 merely by double arrows $\Delta h$.

According to FIGS. 1 to 6, it is provided in each case, during turning, to use typical bending of the ski 100 for the purpose of controlling a parameter-dependent sideways inclination of the sliding surface of the ski 100, said inclination differing from the sideways inclination of the skier's leg in each case.

It is also possible, in principle, to utilize other parameters indicative of turning. For example, it would be possible for the transverse acceleration of the ski which occurs during turning to be registered by means of a corresponding sensor and converted, by active actuating elements, into canting of the ski which is changed relative to the skier's leg. For this purpose, it would be necessary to carry along an energy store assigned to the respective actuating elements.

Moreover, it is also possible for the base plate 105, which can be separated from the ski 100 in FIGS. 1 to 6, to be integrated in the ski 100 such that the base plate 105 forms part of the top side of the ski.

It is also possible to arrange the base plate on the boot, such that the inclination of the underside of the sole relative to the shaft of the ski boot changes as a function of parameters typical of turning.

In the case of the embodiment of FIGS. 7 to 10, a stable strip 7, preferably made of metal and, in particular, of aluminum, is fastened on the ski by means of screws 8, beneath the front and the rear end of the base plate 105. In the region of the supporting zones 101 and 103, the strip 7 is provided in each case with a guide 9 which is parallel to the longitudinal direction of the ski and guides the head of a ball-headed screw 10, which has been screwed into the base plate, in a displaceable manner in the longitudinal direction of the ski and secures the same in a positively locking manner vertically and in the transverse direction of the ski. Said ball-headed screw 10 forms in each case one of the supporting elements 106 of the base plate 105 at the supporting zones 101 and 103 (see also FIG. 1).

On that side of the ski 100 which is located opposite the guide 9, there is secured in the strip 7 a pin 11 which projects upward out of the strip 7 and, by way of its free end, forms a stop 12 which limits the movement of the adjacent region of the underside of the base plate 105 approaching the top side of the ski 100.

A compliant elastomeric part 13 is positioned on the free end of the pin 11 by means of a bore arranged in it. Instead of the elastomeric parts 13, it is also possible to provide other resilient elements, e.g. made of metal.

According to FIG. 8, a further strip 7 is fastened on the ski 100, again by means of screws 8, in the region of the supporting zone 102. In the region of the supporting zone 102, said strip 7 has a guide 14 which runs in the transverse direction of the ski and is intended for the head of a further ball-headed screw 10, which is arranged on the base plate 105 and forms that supporting element 106 from FIGS. 2 to 5 which is assigned to the supporting zone 102.

On that side of the ski 100 which is located opposite the supporting zone 102, there is arranged in the strip a pin 15 on which the base plate 105 rests when it assumes its position without inclination in the transverse direction of the ski 100, said position being illustrated in FIG. 8.

FIGS. 9 and 10, then, show the functioning, during turning, of the arrangement described with reference to FIGS. 7 and 8, it being assumed that the center of the turning curve is located in arrow direction Z in each case in the example of FIGS. 9 and 10 and that the ski 100 illustrated in FIGS. 9 and 10, in relation to the turning curve skied, forms the outer ski. The bending of the ski 100 which occurs during turning then results in a sideways inclination of the base plate 105 relative to the ski 100, i.e., in sectional illustration of FIGS. 9 and 10, the base plate 105 and the ski 100 form an angle which opens toward the center of the turning curve. This is synonymous with the base plate 105, in FIG. 9, being inclined in the downward direction toward the outside of the turning curve through the angle $\alpha$ relative to a transverse axis of the ski 100.

Since, during turning, it has to be assumed that the skier's legs, and thus the vertical axis of the base plate 105, are inclined toward the inside of the turning curve, the oblique position of the base plate 105 relative to the ski 100 necessarily results in the vertical axis of the ski 100 illustrated in FIGS. 9 and 10 being inclined toward the inside of the turning curve to a more pronounced extent than the skier's legs, with the result that longitudinal edge 16 of the ski 100 which is on the inside of the turning curve digs into the underlying surface with extremely pronounced edging.

In the case of the illustrated inclining movement of the base plate 105 relative to the ski, the elastomeric parts 13 are pressed down. At the same time, the base plate 105 lifts up from the pin 15.

The longitudinal and transverse guidance of the ball heads of the ball-headed screws 10 in the longitudinal and transverse guides 9 and 14, respectively, ensures that the ski 100 can bend relative to the base plate 105 as far as possible without constraint in accordance with the respective turning action. It is merely by the compression of the elastomeric parts 13 that a more or less pronounced restoring force is produced between the ski 100 and base plate 105. At the same time, the elastomeric parts 13 have a damping effect in relation to the bending vibrations of the ski 100.

Moreover, the maximum achievable transverse inclination of the base plate 105 relative to the ski 100 is restricted by the pins 11 in the region of the elastomeric parts 13, e.g. restricted to approximately 5°.

Instead of the ball-headed screws 10 and the guides 9 and 14, it is also possible to provide joints, in particular plastic joints, or hinges with corresponding play.

In the case of the exemplary embodiment of FIGS. 11 to 15, an adjusting device 20 is provided between the ski (not illustrated) and boot (not illustrated), which adjusting device is to be arranged in the manner of a spacer plate. Said adjusting device has a standing plate 6 which serves as a standing surface for the boot and for the purpose of fitting ski-binding units and is adjoined by integral side walls 21 and 22 which are bent at right angles. In this case, the side wall 21 is usually assigned to the inner side of a ski, while the side wall 22 is located on the outside of the respective ski.

Beneath the front and rear longitudinal ends of the standing plate 6, the side wall 21 is integrally adjoined by flat-band-like fastening strips 23 which extend parallel to the standing plate 6 but have a certain capacity for elastic angular movement in relation to the side wall 21, with the result that they can pivot relative to the standing plate 6. Arranged in the fastening strips 23 are in each case two slots 27 which extend parallel to the longitudinal axis of the standing plate 6.

When the fastening strips 23 assume the position in which they are parallel to the standing plate 6, a relatively large spacing perpendicular to the plane of the standing plate 6 remains between the free ends of the fastening strips and stop lugs 25 which are integrally formed on the other side wall 22.

Formed integrally on the other side wall 22, approximately in the center between the fastening strips 23, is a fastening strip 24, which is normally aligned parallel to the plane of the standing plate 6. This fastening strip 24 is also of flexible design or is connected flexibly to the side wall 22, with the result that the fastening strip 24 can pivot relative to the plane of the standing plate 6. In the position in which the fastening strip 24 is parallel to the plane of the standing plate 6, the free end of the said fastening strip 24 butts from beneath against a stop lug 26 which is integrally formed on the side wall 21. Moreover, two round holes 28 are formed in the fastening strip 24.

The adjusting device 20 is fastened on the top side of a ski (not illustrated) by means of screws (not illustrated) which can be inserted, by way of appropriate cutouts 29 in the standing plate 6, into the slots 27 and the round holes 28 of the fastening strips 23 and 24, it being the case that, on account of the slots 27, the fastening strips 23 remain displaceable relative to the ski in the longitudinal direction of the ski. In the state in which the adjusting device 20 has been fitted on the ski, the connecting regions between the fastening strips 23 and the side wall 21 form supports corresponding to the supporting elements 106 (see FIG. 3) at the supporting zones 101 and 103 (see FIG. 1), while the connection region between the side wall 22 and the fastening strip 24 corresponds to the supporting element 106 at the supporting zone 102.

When the ski then bends during turning, the standing plate 6 is inclined sideways relative to the ski, analogously to the base plate 105 in FIG. 5.

Said sideways inclination is restricted by the abovementioned spacing between the stop lugs 25 and the free ends of the fastening strips 23, for example restricted to approximately 5°.

When the standing plate 6 is inclined relative to the ski, the fastening strips 23 and 24 are pivoted relative to the respective side wall 21 or 22 connected to them, the respective transition regions bending in the process. Accordingly, said transition regions have to be designed so as to be capable of being subjected to corresponding bending loading or have to consist of correspondingly resilient material, it being possible for the entire adjusting device 20 described to be produced from such material. Examples of suitable materials are sheet aluminum or plastics. However, other resilient materials are also suitable in principle.

The space formed between the top side of the ski and the standing plate 6 may be closed off to the outside or filled using compliant foam material or foam rubber or the like.

In the case of the embodiments of FIGS. 7 to 15, it is the bending of the ski in the longitudinal central region during turning which is utilized for the purpose of parameter-dependent control of the transverse inclination of the standing plate 6 relative to the ski.

FIGS. 16 to 19, then, show schematic illustrations of embodiments in which said parameter-dependent control of the transverse inclination is also possible when the longitudinal central region of the ski is of comparatively flexural rigid design and only the longitudinal ends of the ski can be bent up elastically relative to the central region.

In the case of the embodiment illustrated in FIG. 16, the base plate 105 is secured in the region of the supporting 102 (see FIG. 1) , by means of the supporting element 106 arranged there, at a fixedly predetermined spacing from the top side of the ski, but such that the base plate 105 can pivot relative to the ski 100 about a longitudinal axis of the ski.

Supporting elements of controllable height are provided at the supporting zones 101 and 103, and these supporting elements, in the example of FIG. 16, each comprise a wedge element 108, which is fastened on the base plate 105, and a mating wedge element 109, which can be disclosed in the longitudinal direction of the ski. The mating wedge elements 109 are each connected, via a rod 110, to an abutment 111 arranged on the top side of the front end and of the rear end of the ski 100, with the result that the mating wedge elements 109 are forcibly displaced in the longitudinal direction of the ski, the height of the supporting elements formed by the respective wedge element 108 and the respective mating wedge element 109 being changed in the process, when the front and rear ends of the ski are bent up relative to the central region of the ski 100.

In the example of FIG. 16, the interacting oblique surfaces of the wedge elements 108 and mating wedge elements 109 are inclined in each case such that the height of the supports formed by the elements 108 and 109 in each case is increased when the ends of the ski are bent in the upward direction relative to the central region of the ski.

However, it is also conceivable, in principle, for the abovementioned oblique surfaces to be inclined in the opposite direction. Nevertheless, in this case, the left and right skis in FIG. 1 have to be changed over if the intention is to ensure enhanced canting of the ski on the outside of the turning curve during turning.

The embodiment of FIG. 17 differs from the embodiment of FIG. 16 essentially just by the fact that the rods 110 each adjoin the toggle joints of toggle-lever arrangements 112 which support and secure the base plate 105 at the supporting zones 101 and 103 (see FIG. 1) in relation to the ski 100. When the toggle-lever arrangements 112, as the skier is skiing normally straight ahead on a level piste, assume the positions illustrated in FIG. 17, there is an increase in the vertical height of the toggle-lever arrangements 112 relative to the top side of the ski when the ends of the ski are bent up relative to the longitudinal central region of the ski 100.

If, on the other hand, the toggle-lever arrangements 112 were normally to assume their straightened-out state or the position indicated by dashed lines in FIG. 17, there would be a decrease in the vertical height of the toggle-lever arrangements during the abovementioned upward bending of the ends of the ski.

In the case of the embodiment illustrated in FIG. 18, that end of each rod 110 which is directed away from the abutment 111 is connected in each case to a guide element 113 or the like which is guided, on the one hand, in a guide slot 114, which extends in the longitudinal direction of the ski and belongs to the supporting part 115 on the ski, and, on the other hand, in an oblique guide slot 116, which belongs to a supporting part 117 arranged fixedly on the base plate 105. In this case, the guide slots 116 are each arranged in an inclined manner such that, when the ends of the ski move upward relative to the longitudinal central region of the ski 100, there is an increase in the vertical height of the supports formed by the supporting parts 115 and 117 in each case. Such an increase in height also occurs when the oblique guide slot 116 is formed in the supporting part 115 on the ski and the guide slot 114 which is parallel to the ski is formed in the supporting part 117 of the base plate 105.

If the oblique guide slots 116 are inclined in the opposite direction, this causes a reduction in the vertical height of the abovementioned supports when the ends of the ski bend upward.

FIG. 19 shows an embodiment in the case of which the base plate 105 is supported at the supporting zones 101 and 103 (see FIG. 1) in each case by piston/cylinder units 118 which are each connected hydraulically to a piston/cylinder unit 119, of which the piston is actuated by one of the rods 110 in each case. When the ends of the ski bend upward relative to the longitudinal central region of the ski 100, this forcibly expands the piston/cylinder units 118, with the result that, in turn, there is a corresponding change in the transverse inclination of the base plate 105 relative to the ski 100.

In the case of the embodiments illustrated in FIGS. 16 to 19, there is a change in each case in the vertical height of the supports in the region of the supporting zones 101 and 103 (see FIG. 1). It is also possible, in principle, to keep the vertical height of these supports constant and to change the vertical height of the support in the region of the supporting zone 102. For this purpose, it is possible to use correspondingly those designs for height-adjustable supports which are illustrated schematically above with reference to FIGS. 16 to 19. In the case of such an arrangement, just a single rod 110 need to be arranged on the front end or the rear end of the ski 100 since it is only the vertical height of a single support which has to be changed in each case.

Otherwise, the variants illustrated in FIGS. 16 to 19 may be modified by omitting the fixed-height support of the base plate 105 in the region of the supporting zone 102 (see FIG. 1) and replacing it by two fixed-height supports which may be arranged more or less as desired on that longitudinal side of the ski 100 which is located opposite the supporting zones 101 and 103, in particular they may be arranged in each case approximately opposite the supporting zones 101 and 103.

In the case of the above, it has been assumed that bending of the ski or bending of the ends of the ski results in a change in sideways inclination of the base plate 105 or of the standing plate 6 relative to the ski 100. However, it is also possible, in principle, for the ski 100 and/or the supports of the standing plate 6 or of the base plate 105 on the ski 100 and/or elements which, like the abutments 111 and the rods 110, serve for the purpose of controlling the transverse inclination of the standing plate 6 or of the base plate 105, to be designed in an elastically compliant manner such that, although there is no significant change in the transverse inclination of standing plate 6 or base plate 105 relative to the ski 100, the longitudinal edge of the ski is subjected to increased ground pressure.

FIGS. 20 and 21 illustrate the effect of the invention:

If in the case of a conventional ski 100, according to FIG. 20, the standing surface 200 for the ski boot (or the plane of the sole thereof) is tilted by, for example, 40° in the transverse direction in relation to the underlying surface, the ski is canted by the same angle of 40°.

In the case of the arrangement according to the invention, in contrast, it is possible to achieve the situation where at least one ski 100, in particularly the ski on the outside of the turning curve, is subject to canting, of 45° for example, which is increased in relation to the tilting (40°) of the standing surface 200 (or plane of the sole) . As a result, the sideways inclination of the shaft of the ski boot, said inclination being indicated by the line 300, is less than the sideways inclination assumed by the vertical axis 400 of the ski 100.

When the skier is skiing normally straight ahead, the line 300 and the vertical axis 400 may coincide with one another, see FIG. 22.

What is claimed is:

1. An adjusting device for adjusting an angle between a vertical axis of a ski boot and a vertical axis of the sliding surface of an associated ski, wherein the adjusting device operates as a function of parameters correlated with turning of the associated ski by a skier causing parameter-dependent pivoting of the ski boot vertical axis about a longitudinal axis of the associated ski relative to the vertical axis of the sliding surface of the ski, and a parameter-dependent adjusting force for changing an angle of the ski boot vertical axis about the longitudinal axis of the ski relative to the vertical axis of the sliding surface of the ski, such that during turning when the vertical axis of the boot is inclined obtusely with respect to a gliding surface, the vertical axis of the sliding surface of the ski is inclined to an angle greater than the vertical axis of the boot with respect to the gliding surface.

2. The device as claimed in claim 1, wherein the adjusting device is arranged on the ski.

3. The device as claimed in claim 2, wherein the adjusting device is arranged between the ski and one of the ski boot and a ski binding.

4. The device as claimed in claim 1, wherein provided on the ski is a standing or base plate which is secured vertically, on one longitudinal side of the ski, on two supporting zones which are spaced apart from one another in the longitudinal direction of the ski and, on the other longitudinal side of the ski, on a further supporting zone, which is offset in the longitudinal direction of the ski with respect to the two supporting zones mentioned above, with the result that bending of the ski in the region of the supporting zones results in a transverse inclination or in a change in the transverse inclination of the base plate relative to the ski.

5. The device as claimed in claim 1, wherein arranged on the ski is a standing or base plate which, on one longitudinal side of the ski, is secured essentially fixedly in a vertical direction and, on the other longitudinal side of the ski, is secured with the capacity for vertical height adjustment, the height adjustment being predetermined by parameters correlated with turning.

6. The device as claimed in claim 5, wherein the height adjustment can be controlled as a function of one of bending of the ski and bending of parts of the ski.

7. The device as claimed in claim 6, wherein arranged between the standing or base plate and ski or parts of the ski are resilient elements which force the standing or base plate into a normal position relative to the ski.

8. The device as claimed in claim 1, wherein the parameter-dependent pivoting of the ski boot vertical axis relative to the vertical axis of the sliding surface of the ski is in a range between approximately 0° and 10°.

9. The device as claimed in claim 8, wherein the maximum pivoting is restricted to approximately 5°.

* * * * *